US006389712B1

(12) United States Patent
Schelling

(10) Patent No.: US 6,389,712 B1
(45) Date of Patent: May 21, 2002

(54) REPLACEABLE SHOE SOLE

(76) Inventor: John W. Schelling, 13 Melody La., Orinda, CA (US) 94563

( * ) Notice: Subject to any disclaimer, the term of this patent is extended or adjusted under 35 U.S.C. 154(b) by 0 days.

(21) Appl. No.: 09/563,236

(22) Filed: May 2, 2000

(51) Int. Cl.[7] ..... A43C 13/00

(52) U.S. Cl. ..... 36/15; 36/31; 36/30 R; 36/103; 36/36 R; 36/42

(58) Field of Search ..... 36/15, 31, 36 R, 36/36 A, 114, 103, 30 R, 25 R, 42, 101, 23, 24, 131

(56) References Cited

U.S. PATENT DOCUMENTS

| | | | | | |
|---|---|---|---|---|---|
| 430,234 | A | | 6/1890 | Melaney | |
| 1,205,421 | A | | 11/1916 | Applegate | |
| 1,399,542 | A | | 12/1921 | Chenery | |
| 1,773,242 | A | | 8/1930 | Siekacz | |
| 1,786,374 | A | | 12/1930 | Walton | |
| 1,936,637 | A | | 11/1933 | Manfra | |
| 1,950,041 | A | | 3/1934 | Torchia et al. | |
| 2,234,542 | A | | 3/1941 | Anderson | |
| 3,100,354 | A | | 8/1963 | Lombard et al. | |
| 3,130,504 | A | | 4/1964 | Deitch | |
| D212,521 | S | | 10/1968 | Herunter | |
| 3,982,336 | A | | 9/1976 | Herro | |
| 4,317,294 | A | | 3/1982 | Goodyear | |
| 4,586,209 | A | | 5/1986 | Bensley | |
| 4,606,139 | A | * | 8/1986 | Silver | 35/15 |
| 4,610,100 | A | | 9/1986 | Rhodes | |
| 4,783,853 | A | | 11/1988 | Zuber | |
| 4,974,344 | A | | 12/1990 | Ching | |
| 5,070,631 | A | | 12/1991 | Fenton | |
| 5,280,680 | A | | 1/1994 | Burke et al. | |
| 5,317,822 | A | | 6/1994 | Johnson | |
| 5,421,104 | A | * | 6/1995 | Talley | 36/42 |
| 5,519,950 | A | | 5/1996 | Wang | |
| 5,533,280 | A | | 7/1996 | Halliday | |
| D373,674 | S | | 9/1996 | Dolinsky | |
| 5,644,857 | A | | 7/1997 | Ouellette et al. | |
| D390,345 | S | | 2/1998 | Aird et al. | |
| 5,775,005 | A | * | 7/1998 | McClelland | 36/31 |
| D401,739 | S | | 12/1998 | James | |
| D405,596 | S | | 2/1999 | Aird et al. | |
| 6,065,228 | A | * | 5/2000 | Begey et al. | 36/12 |
| 6,092,251 | A | * | 7/2000 | Tomat | 12/142 P |
| 6,115,946 | A | * | 9/2000 | Morris et al. | 36/115 |

FOREIGN PATENT DOCUMENTS

| | | |
|---|---|---|
| WO | 8604489 | 8/1986 |

* cited by examiner

*Primary Examiner*—Mickey Yu
*Assistant Examiner*—Jila M. Mohandesi
(74) *Attorney, Agent, or Firm*—Roylance, Abrams, Berdo & Goodman, L.L.P.

(57) ABSTRACT

A shoe having a shoe sole with replaceable outsole portions. The shoe sole includes a main sole having a lower support wall with first and second cavities. An insole is disposed within the main sole. First and second lower outsoles are received in the first and second cavities, respectively, and have outer configurations corresponding to the configurations of the cavities thereby forming a snug fit therebetween. Fasteners are inserted through apertures disposed in the outsoles, the main sole, and the insole, releasably securing the outsoles to the main sole. Upon removing the fasteners, the outsoles can be removed and replaced with different outsoles for different conditions and applications or when worn out. The outsoles are formed of two layers, with the upper layer being more rigid than the lower layer to provide a firm surface against which the fastening screw heads can press.

1 Claim, 3 Drawing Sheets

Fig. 4
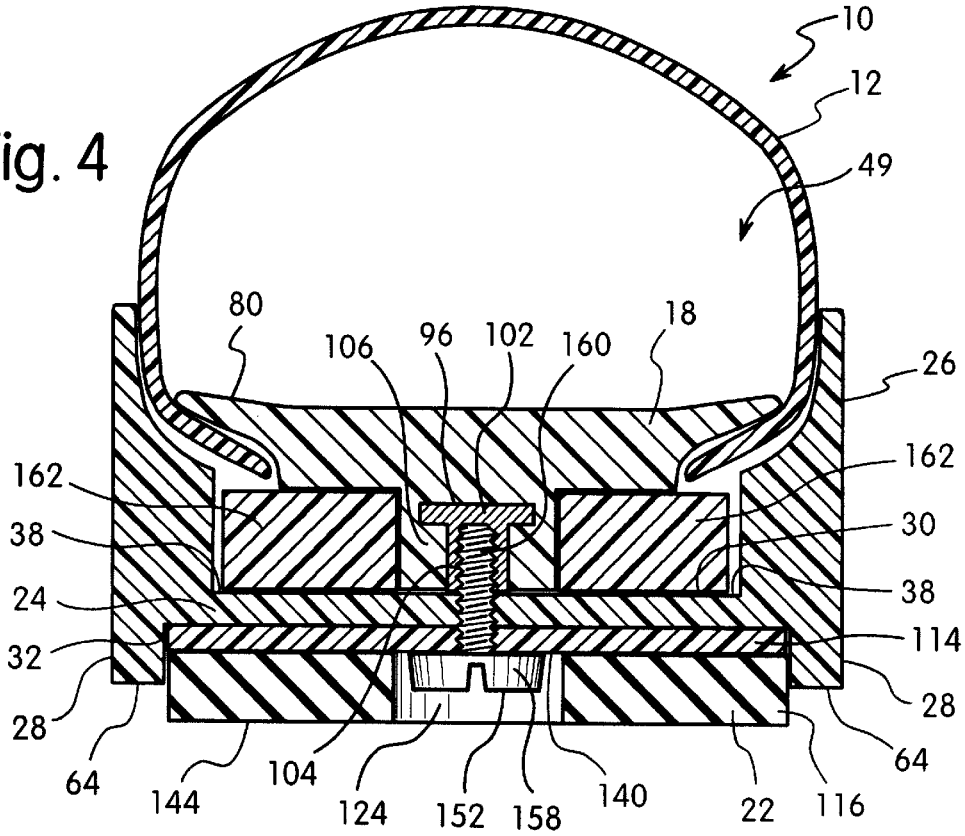
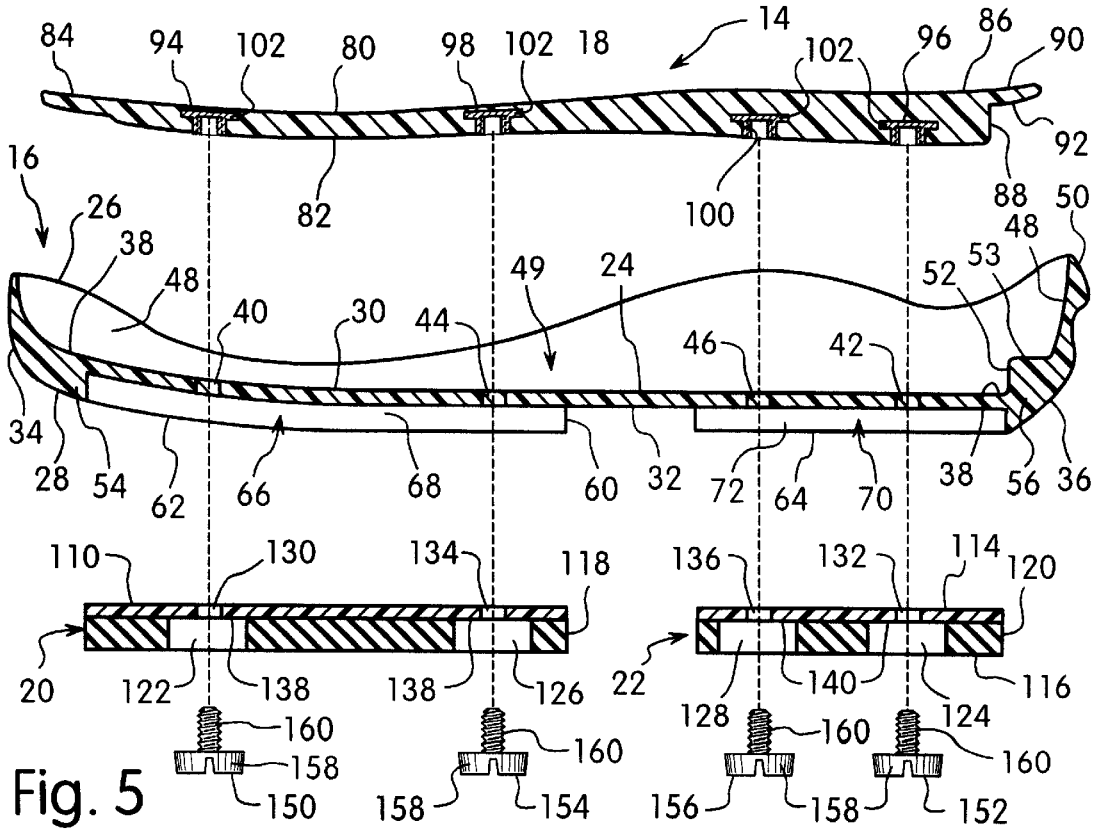
Fig. 5

REPLACEABLE SHOE SOLE

BACKGROUND OF THE INVENTION

Conventional shoes have a heel and sole fixedly attached, by gluing or other attachment process, to an outsole of the shoe body. However, when the sole or heel is damaged or worn out, the sole or heel must be completely separated from the shoe outsole before a new sole or heel can be selected and attached to the shoe. Typically, a skilled shoe repairman is needed to effectuate the repairs, which is costly and usually takes some time. In addition, where it is desirable for a new sole or heel to be placed on a shoe in order to accommodate differing environments, such as for indoor conditions or for outdoor conditions, such as rain or snow, consumers often discard the entire shoe rather than going through the time and expense of replacing the sole or the heel.

Prior art shoes do not provide replaceable soles and heels or soles that are easily removed and replaced. In addition, conventional shoes cannot accommodate different soles or heels according to changing conditions and applications. Furthermore, the outsoles of the prior art conventional shoes do not securely hold the replaceable sole or heel, allowing the sole or heel to move with respect to the shoe upper.

Examples of prior art shoes with replaceable heels are the following U.S. Pat. Nos.: U.S. Pat. No. 430,234 to Melaney; U.S. Pat. No. 1,205,421 to Applegate; U.S. Pat. No. 1,399,542 to Chenery; U.S. Pat. No. 1,773,242 to Siekacz; U.S. Pat. No. 1,786,374 to Walton; U.S. Pat. No. 1,936,637 to Manfra; U.S. Pat. No. 1,950,041 to Torchia et al; U.S. Pat. No. 2,234,542 to Anderson; U.S. Pat. No. 3,130,504 to Deitch; U.S. Pat. No. 3,982,336 to Herro; U.S. Pat. No. 4,317,294 to Goodyear; U.S. Pat. No. 4,586,209 to Bensley; U.S. Pat. No. 4,606,139 to Silver; U.S. Pat. No. 4,610,100 to Rhodes; U.S. Pat. No. 4,783,853 to Zuber; U.S. Pat. No. 4,974,344 to Ching; U.S. Pat. No. 5,070,631 to Fenton; U.S. Pat. No. 5,317,822 to Johnson; U.S. Pat. No. 5,421,104 to Tally; U.S. Pat. No. 5,519,950 to Wang; U.S. Pat. No. 5,533,280 to Halliday; and U.S. Pat. No. 5,644,857 to Ouellette et. al; as well as WO 86/04489 to Saffron et. al.

SUMMARY OF THE INVENTION

Accordingly, an object of the present invention is to provide a shoe with a shoe sole that includes outsole portions that can be easily replaced by the wearer of the shoe.

Another object of the present invention is to provide a shoe with a shoe sole that can accommodate a variety of outsole portions.

A further object of the present invention is to provide a shoe with a shoe sole that includes outsole portions that prevent wear to the shoe sole itself.

Yet another object of the present invention is to provide a shoe with shoe sole that securely retains and restricts the movement of the replaceable outsoles.

The foregoing objects are basically attained by a shoe sole comprising a main sole portion having a bottom wall with upper and lower surfaces, opposing first and second ends, and a first fastener hole, the first fastener hole being located proximate the first end, and a lower support wall extending downwardly from the lower surface along a perimeter of the bottom wall forming a first cavity, the first cavity having an inner surface and being located at the first end; an insole portion disposed on the upper surface of the bottom wall having a first fastener receiving bore corresponding to the first fastener hole of the main sole portion; a first lower sole portion having a bottom surface and received in the first cavity such that the bottom surface of the first lower sole portion is substantially below the lower support wall, the first lower sole portion having a first fastener aperture corresponding to the first fastener hole of the main sole portion and to the first fastener receiving bore of the insole portion; and a first fastener extending through the first fastener aperture, the first fastener hole, and the first fastener receiving bore, releasably securing the first lower sole portion to the main sole portion.

The foregoing objects are also attained by a shoe sole comprising a main sole portion having a bottom wall with upper and lower surfaces, opposing first and second ends, and a first fastener hole, the first fastener hole being located proximate the first end, and a lower support wall extending downwardly from the lower surface along a perimeter of the bottom wall forming a first cavity at the first end; an insole portion disposed on the upper surface of the bottom wall having a first fastener receiving bore corresponding to the first fastener hole of the main sole portion; a first lower sole portion having a bottom surface received in the first cavity, the first lower sole portion includes top and bottom layers with the top layer being substantially more rigid than the bottom layer, a first fastener aperture corresponding to the first fastener hole of the main sole portion and to the first fastener receiving bore of the upper sole portion; and a first fastener extending through the first fastener aperture, the first fastener hole, and the first fastener receiving bore, respectively, releasably securing the first lower sole portion to the main sole portion.

By designing the shoe sole in this fashion, the wearer of the shoe can easily replace the first and second lower sole portions with other outsole portions as desired. Also, the shoe sole can accommodate different types of outsoles for different applications. In addition the lower sole portions help to prevent wear on the rest of the shoe sole.

Other objects, advantages and salient features of the invention will become apparent from the following detailed description, which taken in conjunction with the annexed drawings, discloses a preferred embodiment of the invention.

BRIEF DESCRIPTION OF THE DRAWINGS

Referring now to the drawings which form a part of this original disclosure:

FIG. 4 is an enlarged cross-sectional end view of the shoe and shoe sole taken along line 4—4 of FIG. 1, showing the outsole portion mounted by a fastener within a cavity of the shoe sole;

FIG. 5 is an exploded cross-sectional side view of the shoe sole taken along line 5—5 of FIG. 2, showing the insole, the main sole, and the outsoles comprising the shoe sole.

DETAILED DESCRIPTION OF THE INVENTION

Figure 1:
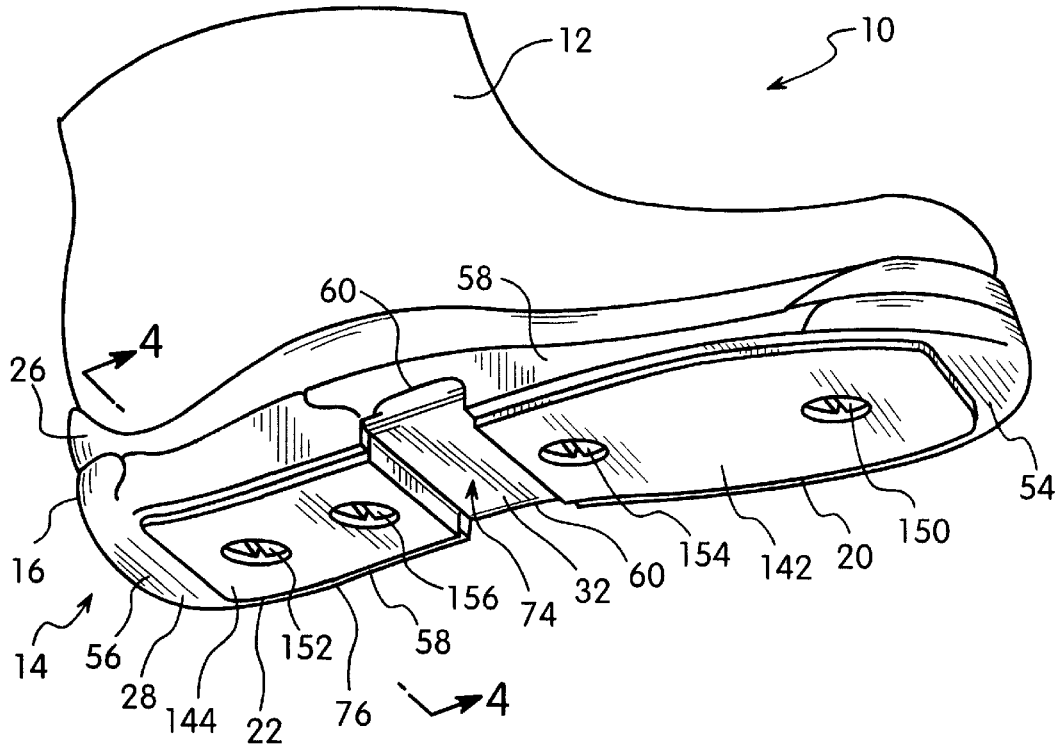
FIG. 1 is a bottom perspective view of the present invention of a shoe and shoe sole according to an embodiment of the present invention, illustrating the replaceable outsole portions assembled with the shoe sole.
Figure 2:
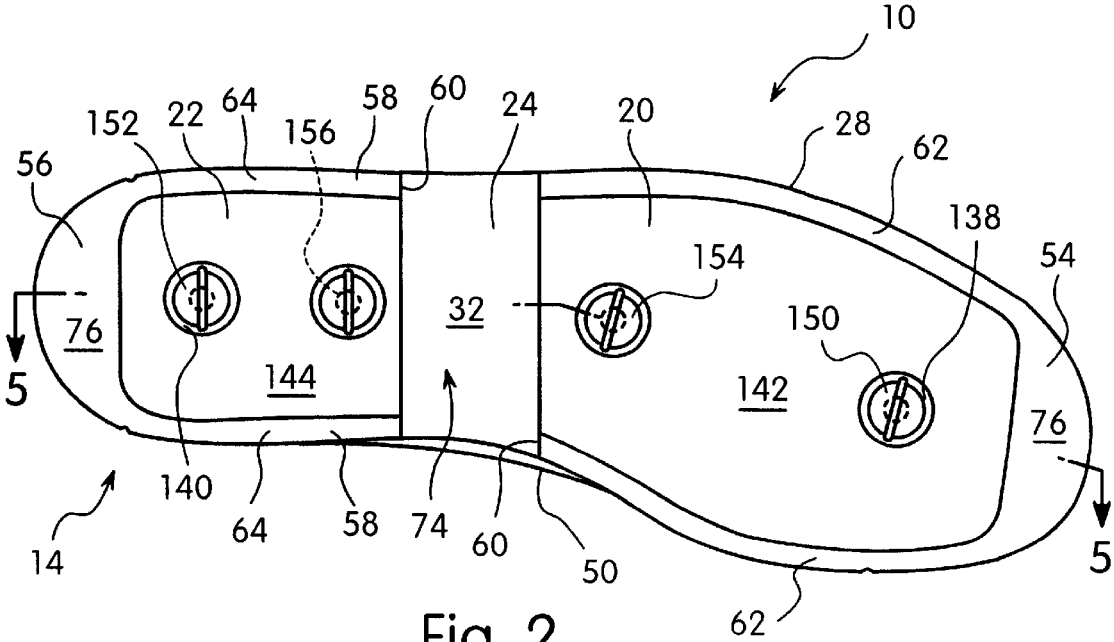
FIG. 2 is a bottom view of the shoe sole illustrated in FIG. 1, showing the replaceable outsole portions assembled with the show sole.

Referring to FIGS. 1–6, a shoe or footwear 10 according to the present invention comprises a shoe upper 12 attached to a shoe sole assembly 14. Shoe sole assembly 14 includes a main sole portion 16, an insole portion 18 disposed on top of main sole portion 16, and first and second lower sole or outsoles portions 20 and 22 attached to the bottom of main sole portion 16. The shoe upper 12 can be of any conventional footwear form, such as a shoe, sandal, boot or sneaker, and can be made of any conventional material such as leather, canvas, plastic, or rubber.

In particular, main sole portion 16 includes a substantially planar bottom wall 24 with an upper support wall 26 extending upwardly therefrom and a lower support wall 28 extending downwardly therefrom, as best seen in FIG. 5.

Figure 3:
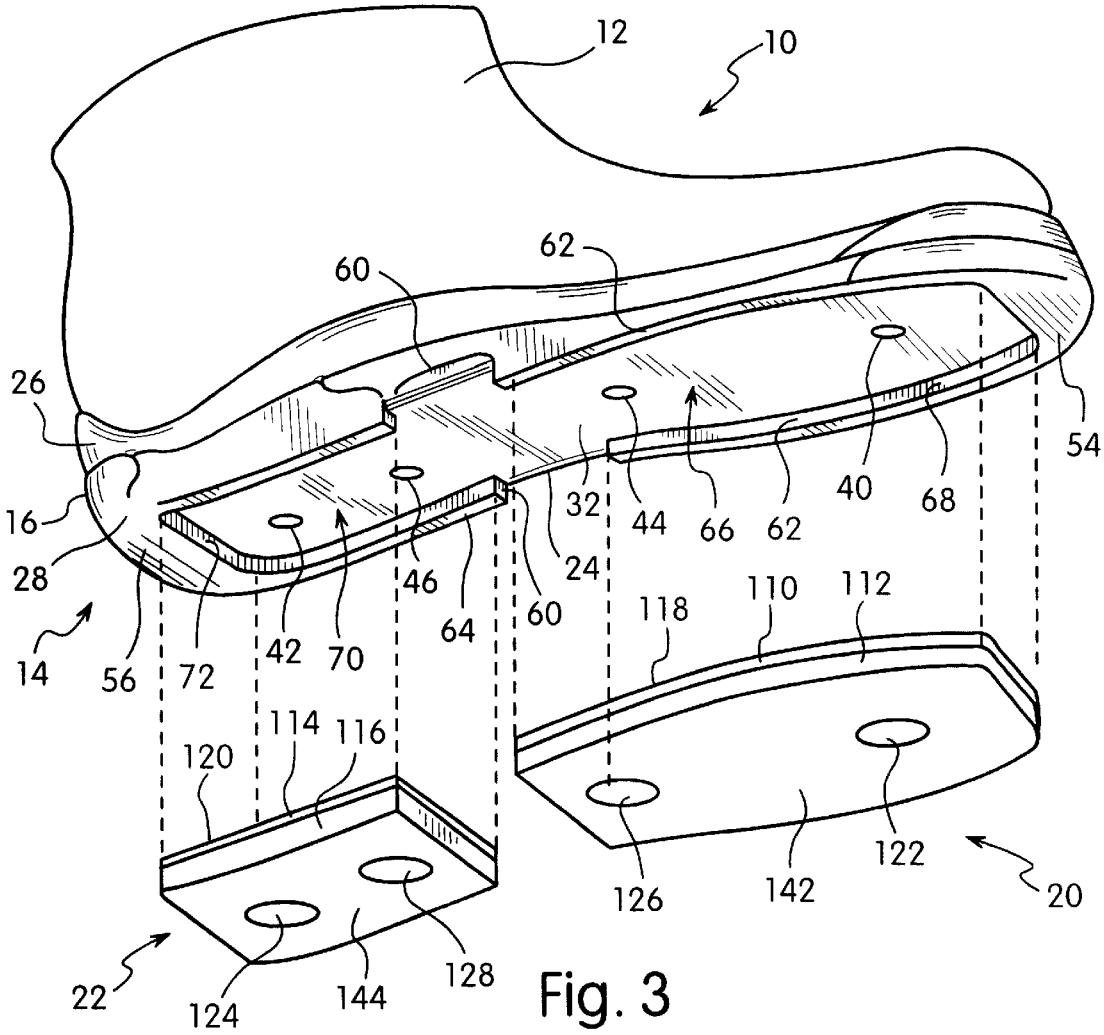
FIG. 3, is a bottom, exploded, perspective view of the shoe and shoe sole illustrated in FIG. 1, showing the outsole portions being inserted into cavities of the shoe sole.

Bottom wall 24 has upper and lower surfaces 30 and 32, a first end or toe bumper 34 and an opposing second end or heel bumper 36. Bottom wall 24 forms an outer perimeter 38 substantially conforming to the outline of a human foot, with first end 34 corresponding to the front of the foot and second end 36 corresponding to the back or heel of the foot. A first fastener hole 40 is disposed in bottom wall 24 proximate first end 34 and a second fastener hole 42 is disposed proximate second end 36, with each hole receiving a fastener when attaching first and second lower sole portions 20 and 22 to main sole portion 16. In addition, a third fastener hole 44 is located near but space from first fastener hole 40 away from first end 34, such that first and third fastener holes 40 and 44 are aligned. Similarly, a fourth fastener hole 46 is aligned with and spaced from second fastener hole 42, as best seen in FIG. 3. Preferably, bottom wall 24 is formed of a material, such as rubber, that has sufficient rigidity to support a human foot but that also allows main sole portion 16 to bend providing comfort to the wearer. However, bottom wall 24 can be formed of a plastic material.

Upper support wall 26 extends from the outer perimeter 38 of bottom wall 24 in an upwardly direction substantially surrounding bottom wall 24. Upper support wall 26 has inner and outer surfaces 48 and 50, wherein inner surface 48 and upper surface 30 of bottom wall 24 form a receiving area 49 that is shaped and sized to receive a temporary last or foot form that is in the shape of a human foot. A temporary last or foot form, as known in the art, is used in making the shoe 10, as will be described in greater detail below. An interior shelf 52 with a substantially planar top surface 53 extends inwardly from inner surface 48 of upper support wall 26 near rear end 36 of bottom wall 24 for supporting a portion of insole portion 18, as best seen in FIG. 5. The height of upper support wall 26 varies forming a curved design providing support for the foot of the wear. In addition, the curved design of upper support wall 26, along with the ornamentation of outer surface 50, provides an aesthetically pleasing shoe design. It is preferable that the upper support wall be formed of any material, such as plastic or rubber, that would provide support for the wearer of the shoe.

Lower support wall 28 extends from outer perimeter 38 of bottom wall 24 in a downwardly direction and has front and rear end walls 54 and 56 that correspond to first and second ends 34 and 36 of bottom wall 24, respectively, and two opposing sidewalls 58 that extend between front and rear end walls 54 and 56. Each sidewall 58 includes a cut-out section 60 forming a pair of first peripheral flanges 62 between cut-out sections 60 and front end wall 54, and a pair of second peripheral flanges 64 between cut-out sections 60 and rear end wall 56.

First peripheral flanges 62 define a first cavity 66 between flanges 62, bottom wall 24, and front end wall 54, such that first cavity 66 has a substantially elongated U-shaped inner surface 68, as best seen in FIG. 3. Similarly, second peripheral flanges 64 define a second cavity 70 between flanges 64, bottom wall 24, and rear end wall 56, such that second cavity has a substantially U-shaped inner surface 72. First and second cavities 66 and 70 are adapted to hold first and second lower sole portions 20 and 22, respectively, with first cavity 66 being substantially larger than second cavity 70. Although it is preferable that first and second cavities 66 and 70 be shaped as described above, first and second cavities 66 and 70 can be of any polygonal or circular shape, as long as first and second cavities 66 and 70 can accommodate first and second lower support portions 20 and 22.

As seen in FIG. 1, upon inserting first and second lower sole portions 20 and 22 into first and second cavities 66 and 70 (shown in FIG. 3), a slot 74 is defined between cut-out sections 60 and the ends of first and second lower sole portions 20 and 22, allowing main sole portion 16 to bend with respect to slot 74. However, first and second cavities 66 and 70 can be combined to form one unitary cavity, thus eliminating slot 74.

Preferably lower support wall 28 is formed of any material that can support bottom wall 24 and a wearer's foot, such as a plastic or rubber material. It is also preferable that upper support wall 26, lower support wall 28, and bottom wall 24 are all made of the same material such that main sole portion 16 is a unitary one-piece member. However, each wall can be formed separably and integrally attached by any known attachment means.

Figure 6:
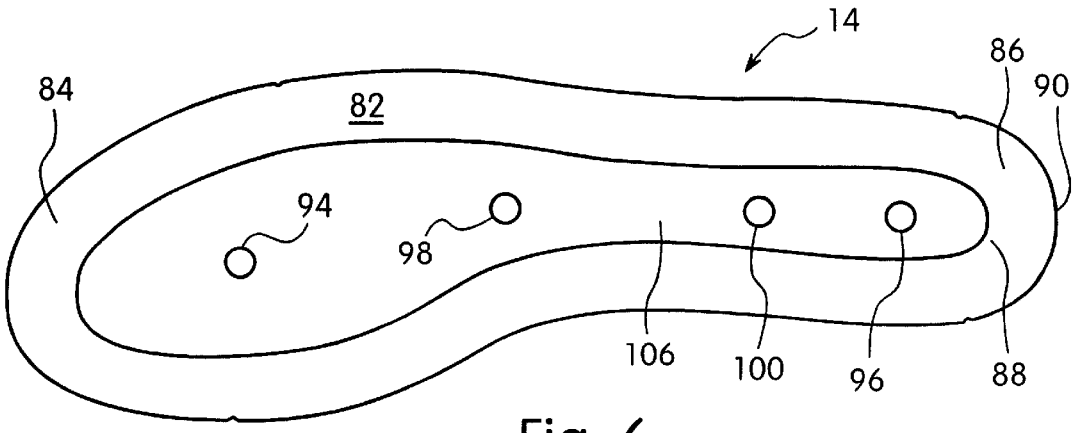
FIG. 6 is an enlarged bottom view of the insole shown in FIG. 5, illustrating the central rib of the insole.

Referring to FIGS. 4–6, insole portion 18 is received in receiving area 49 of main sole portion 16 and is formed of a plastic material that is molded to conform to the shape of bottom wall 24. Insole portion 18 has top and bottom surfaces 80 and 82 with bottom surface 82 being fixedly attached to upper surface 30 of bottom wall 24 by any known attachment, such as adhesive. Insole portion 18 further includes front and rear ends 84 and 86 that correspond to first and second ends 34 and 36 of bottom wall 24, respectively. Rear end 86 particularly includes an inset surface 88 which forms a lip 90 having a substantially planar bottom surface 92, as best seen in FIG. 5. Upon inserting insole portion 18 into receiving area 49, inset surface 88 abuts shelf 52 of upper support wall 26, and bottom surface 92 of lip 90 rests on top surface 53 of shelf 52.

Separable first, second, third, and fourth fastener receiving bores 94, 96, 98, and 100 are embedded and rigidly received in insole portion 18 and are aligned with first, second, third, and fourth fastener holes 40, 42, 44, and 46 of main sole portion 16, respectively. The insole portion 18 must be of sufficient thickness to entirely receive bores 94, 96, 98, and 100, as seen in FIG. 5. Each fastener receiving bore 94, 96, 98, and 100 includes an abutment 102 providing a stop for fasteners inserted therein. Preferably, each fastener receiving bore 94, 96, 98, and 100 is formed of a metal material and has an inner threaded surface 104, but the bores can be formed of any substantially rigid material, such as plastic.

As seen in FIG. 5, insole portion further includes a central rib 106 extending downwardly from bottom surface 82 and tapers in thickness from rear end 84 to front end 86. Central rib 104 provides a natural heel within shoe 10, providing comfort to the wearer of shoe 10, without the necessity of attaching a heel to the outside of shoe 10. Central rib 106 extends along a substantial portion of the length of insole portion 18 and is centrally disposed thereon, as best seen in FIG. 6. First and third fastener receiving bores 94 and 98 are embedded partially in central rib 104 and partially in insole portion 18. In contrast, second and fourth receiving bores 96 and 100 are entirely embedded in central rib 104.

Referring to FIGS. 1–5, first and second lower sole portions 20 and 22 are received in first and second cavities 66 and 70 of main insole portion 16. First lower insole portion 20 includes a first top layer 110 attached to a first bottom layer 112, and second lower sole portion 22 includes a second top layer 114 attached to a second bottom layer 116. Each of first and second top layers 110 and 114 is substantially more rigid than each of first and second bottom layers 112 and 116, respectively, such that top layers 110 and 114 are stronger and have a higher tear strength than bottom layers 112 and 114. Preferably, first and second top layers 110 and 114 are formed of any substantially rigid material, such as plastic or metal. First and second bottom layers 112 and 116 can be formed of various materials such as, a cushioning material, a traction enhancing material, rubber, plastic, felt, or foam. However, first and second top layers 110 and 114 and first and second bottom layers 112 and 116 can be formed of the same material and be formed as one unitary member.

Each of first and second lower sole portions 20 and 22 has first and second outer configurations 118 and 120, respectively, that conform to the shape of first and second cavities 66 and 70, respectively, providing a snug fit upon inserting first and second lower sole portions 20 and 22 into first and second cavities 66 and 70. Specifically, first outer configuration 118 has a U-shape, with two elongated slightly curved sides extending between two straight sides, that corresponds to the shape of inner surface 68 of first cavity 66. Likewise, second outer configuration 120 is rectangular, with each side being substantially straight, and corresponds to the shape of inner surface 72 of second cavity 70. As with first and second cavities 66 and 70, first and second lower support portions 20 and 22 can be of any polygonal or circular shape, as they correspond to and can be received in first and second cavities 66 and 70, respectively. In addition, a single lower sole portion can be employed, instead of two portions, with a single cavity in lower support wall 28.

First and third fastener apertures 122 and 126 are disposed in first lower sole portion 20 and correspond with first and third fastener holes 40 and 44 of main sole portion 16. First and third fastener apertures 122 and 126 include first and third openings 130 and 134, respectively, formed in first top layer 110. First and third openings 130 and 134 are substantially smaller than first and third fastener apertures 122 and 126, leaving a portion of the bottom surface 138 of first top layer 110 exposed, as best seen in FIG. 5. Similarly, second and fourth fastener apertures 124 and 128 are disposed in second lower sole portion 22 and correspond with second and fourth fastener holes 42 and 46 of main sole portion 16. Second and fourth fastener apertures 124 and 128 include smaller second and fourth openings 132 and 136, respectively, formed in second top layer 114 such that, like first top layer 110, a portion of the bottom surface 140 of second top layer 114 is left exposed.

ASSEMBLY

To assemble shoe 10, insole portion 18 is temporarily inserted into a last or foot form (not shown). Shoe upper 12 can then be stretched over the foot form and attached to bottom surface 82 of insole portion 18 shaping show upper 12 into a desired form. The show upper 12 and insole portion 18 can then be inserted into receiving area 49 of main sole portion 16 and placed and attached to bottom wall 24 such that first, second, third, and fourth fastener receiving bores 94, 96, 98, 100 line up with first, second, third, and fourth fastener holes 40, 42, 44, and 46 of main sole portion 16. The last can then be removed. A tapered filler insert 162 is inserted between bottom wall 24 and insole portion 18 to fill up the space between bottom wall 24 and insole portion 18 created by central rib 106, as best seen in FIG. 5. Filler insert 162 is tapered to match the taper of central rib 106.

First and second lower sole portions 20 and 22 are then inserted into first and second cavities 66 and 70 such that first, second, third, and fourth fastener receiving apertures 122, 124, 126, and 128 also line up with first, second, third, and fourth fastener holes 40, 42, 44, and 46 of main sole portion 16.

As seen in FIGS. 1–5, first, second, third, and fourth fasteners 150, 152, 154, and 156, each having a head portion 158 and a threaded portion 160, are employed to fasten first and second lower sole portions 20 and 22 to main sole portion 16 and insole portion 18. Specifically, first and third fasteners 150 and 154 are first inserted through first and third fastener apertures 122 and 126, then through first and third openings 130 and 134, then through first and third fastener holes 40 and 44, and then finally inserted into first and third fastener receiving bores 94 and 98, respectively. Likewise, second and fourth fasteners 152 and 156 are first inserted through second and fourth fastener apertures 124 and 128, then through second and fourth openings 132 and 136, then through second and fourth fastener holes 42 and 46, and then finally inserted into second and fourth fastener receiving bores 96 and 100, respectively.

Upon tightening each fastener, head portions 158 of first and third fasteners 150 and 154 abut the exposed portion of bottom surface 138 of first top layer 110 of first lower sole portion 20, and threaded portions 160 engage threaded surfaces 104 of first and third fastener receiving bores 94 and 98, releasably securing first lower sole portion 20 to main sole portion 16 and insole portion 18. Similarly, head portions 158 of second and fourth fasteners 152 and 156 abut the exposed portion of bottom surface 140 of second top layer 114 of second lower sole portion 22, and threaded portions 160 engage threaded surfaces 104 of second and fourth fastener receiving bores 96 and 100, releasably securing second lower sole portion 22 to main sole portion 16 and insole portion 18. Once secured to main sole portion 16, cavities 66 and 70 snugly hold first and second lower sole portions 20 and 22. Lower support wall prevents dirt from entering between first and second lower sole portions 20 and 22 and first and second cavities 66 and 70, respectively.

In addition, first and second lower sole portions 20 and 22 include bottom surfaces 142 and 144, respectively, such that when inserted within first and second cavities 66 and 70, respectively, bottom surfaces 142 and 144 extend below the bottom surface 76 of lower support wall 28, preventing wear on lower support wall 28.

Although it is preferable to have two fasteners to mount each of the first and second lower sole portions 20 and 22, only one fastener for each portion is necessary. In particular, third and fourth fasteners 154 and 156 can be eliminated along with third and fourth fastener apertures 126 and 128, third and fourth fastener holes 44 and 46, and third and fourth fastener receiving bores 98 and 100. In addition, first and second lower support portions 20 and 22 can include tongue elements (not shown) which engage corresponding slots (not shown) in lower support wall 28 to further secure first and second lower sole portions 20 and 22 within first and second cavities 66 and 70.

OPERATION

In operation, the wearer of shoe 10, can easily replace first and second lower sole portions 20 and 22 with different lower sole portions for different applications. For example, the wearer may want to employ different soles for indoor versus outdoor activities, or for varying weather conditions or for traction on differing types of terrain. The wearer simply loosens and removes first, second, third, and fourth fasteners 150, 152, 156, and 158, removes first and second sole portions 20 and 22, and replaces them with other desired sole portions that suit a particular application. First, second, third, and fourth fasteners 150, 152, 156, and 158 can then be re-inserted in the same manner as described above.

While a particular embodiment has been chosen to illustrate the invention, it will be understood by those skilled in the art that various changes and modifications can be made therein without departing from the scope of the invention as defined in the appended claims.

What is claimed is:

1. A shoe sole, comprising:

a main sole portion having a bottom wall with upper and lower surfaces, opposing first and second ends, and a first fastener hole, said first fastener hole being located proximate said first end, and a lower support wall extending downwardly from said lower surface along a perimeter of said bottom wall forming a first cavity, said first cavity having an inner surface and being located at said first end;

an insole portion having a downwardly extending central rib that rests on said upper surface of said bottom wall, and a first fastener receiving bore corresponding to said first fastener hole of said main sole portion disposed in said central rib;

a first lower sole portion received in said first cavity and having a first fastener aperture corresponding to said first fastener hole of said main sole portion and to said first fastener receiving bore of said insole portion; and a first fastener extending through said first fastener aperture, said first fastener hole, and said first fastener receiving bore, releasably securing said first lower sole portion to said main sole portion.

* * * * *